US005197682A

United States Patent [19]

Del Zotto

[11] Patent Number: 5,197,682

[45] Date of Patent: Mar. 30, 1993

[54] PORTABLE HYDRAULIC SHREDDER

[76] Inventor: William M. Del Zotto, 2300 Commonwealth Ave., Duluth, Minn. 55808-1699

[21] Appl. No.: 815,391

[22] Filed: Dec. 31, 1991

[51] Int. Cl.[5] ..... B02C 21/00

[52] U.S. Cl. ..... 241/101.7; 241/239

[58] Field of Search ..... 241/101.7, 282, 186.4, 241/222, 224, 239, 259.2, 294

[56] References Cited

U.S. PATENT DOCUMENTS

| | | | |
|---|---|---|---|
| 1,840,749 | 1/1932 | Stresau | 241/101.7 |
| 3,559,898 | 2/1971 | Rinke | 241/101.7 |
| 4,037,799 | 7/1977 | Urban | 241/101.7 X |
| 4,961,542 | 10/1990 | Den Besten et al. | 241/101.7 |

*Primary Examiner*—Douglas D. Watts
*Attorney, Agent, or Firm*—D. L. Tschida

[57] ABSTRACT

Portable tractor, trailer apparatus for shredding varieties of materials, including asphalt, concrete, wood, demolition and landfill debris. A fifth-wheel mounted trailer includes a collection hopper having a hydraulically driven end-wall which directs materials into a cutter-head. The cutter head is indirectly driven by a pair of hydraulic drive motors, transfer belts and tensioned pulleys. A pivoting floor section includes a number of spaced apart rakers determines the size of exhausted particulates. The cutter-head includes teeth which clear an axle space at each sidewall and teeth which distribute materials across the width of the head. The head is removable via sidewall channels provided in the support framework.

14 Claims, 8 Drawing Sheets

PORTABLE HYDRAULIC SHREDDER

BACKGROUND OF THE INVENTION

The present invention relates to a shredding apparatus and, in particular, to a trailerable assembly for size reducing varieties of materials fed into the assembly.

Varieties of shredding devices including multi-toothed rotary drums have been developed. Some of these assemblies have found application in road construction for grinding away asphalt or concrete road surfaces. Typically such assemblies provide one or more cutter-heads which are biased into contact with a road surface to eat away the surface.

Applicant is also aware of some assemblies which are remotely located and fed with debris that is transported to the grinder. These latter assemblies are extremely costly and find principle application only for very large construction/demolition projects.

Otherwise, applicant is aware of a transportable assembly which includes means for alternatively grinding debris or selectively compacting debris fed into a debris hopper. Power is obtained via an on-board engine and interconnected drive belt system that extends the length of the assembly. Although transportable, this assembly is very costly and due to the arrangement of components, very difficult to maintain and service in the event of jamming.

In distinction to the foregoing devices, applicant has developed an assembly which is readily transported with a conventional fifth-wheel transport tractor and which is easily maintained, serviced and cleared in the event of jams. The assembly is powered from a detached hydraulic pump at the transport tractor or an engine powered pump separately coupled to the assembly.

SUMMARY OF THE INVENTION

It is accordingly a primary object of the present invention to provide a trailerable shredder or material reduction assembly for concrete, asphalt, demolition and landfill debris, and pulp wood, among a variety of other materials.

It is a further object of the invention to provide a hydraulically powered assembly which obtains power from a power take-off at a transport tractor.

It is a further object of the invention to provide an assembly wherein the cutter-head is powered via independent hydraulic motors indirectly coupled to the head via separate pairs of belt driven, pulleys secured to each end of a head drive shaft.

It is a further object of the invention to provide a cutter-head support frame which permits vertical head removal.

It is a further object of the invention to provide a cutter-head including teeth arranged on replaceable sections to self-distribute the material across the width of the head and to clean and prevent jamming of the head at spaces between the ends of the head and the support framing.

It is a further object of the invention to provide an assembly which facilitates the mounting of debris conveyor means to the assembly for removing shredded materials.

Various of the foregoing objects, advantages and distinctions of the invention are particularly obtained in a preferred construction wherein the shredder assembly is configured about a trailer framework which couples to the fifth-wheel dollie of a transport tractor. A hydraulic take-off pump at the tractor pressurizes a hydraulic fluid reservoir and drive system at the trailer. The shredder includes an elevated operator's platform and adjacent to which hydraulic support assemblies are mounted.

A hydraulic ram extends from the fore-end of the shredder to control to and fro motion of a reinforced endwall of a collection hopper. Materials received at the hopper are directed into a dimensionally controlled channel space and a hydraulically driven cutter-head at the aft end of the assembly. A pivoting floor section mounted beneath the head determines the aperture of a reduction channel and the ejected particulate size. The moveable floor section also facilitates clearing in the event of jams via an expansion of the opening.

The cutter-head includes a plurality of hardened teeth which mount in parallel, diagonally arranged rows which extend the width of the head. Ones of the teeth are directed to sweep the space between the sides of the head and adjacent support framing to prevent jamming or obstruction of the head rotation. A pair of slots formed in vertical sidewall channels adjacent the head drive shaft facilitate removal and maintenance of the cutter-head. The support framing also includes means for coupling to debris conveyor means.

Still other objects, advantages and distinctions of the invention will become more apparent hereinafter from the following detailed description with respect to the appended drawings. Although described with respect to a presently preferred construction and various modifications and improvements thereto, the description should not be interpreted in strict limitation of the invention. Rather, the scope of the invention should be interpreted from the following appended claims.

DESCRIPTION OF THE PREFERRED EMBODIMENT

Figure 1:
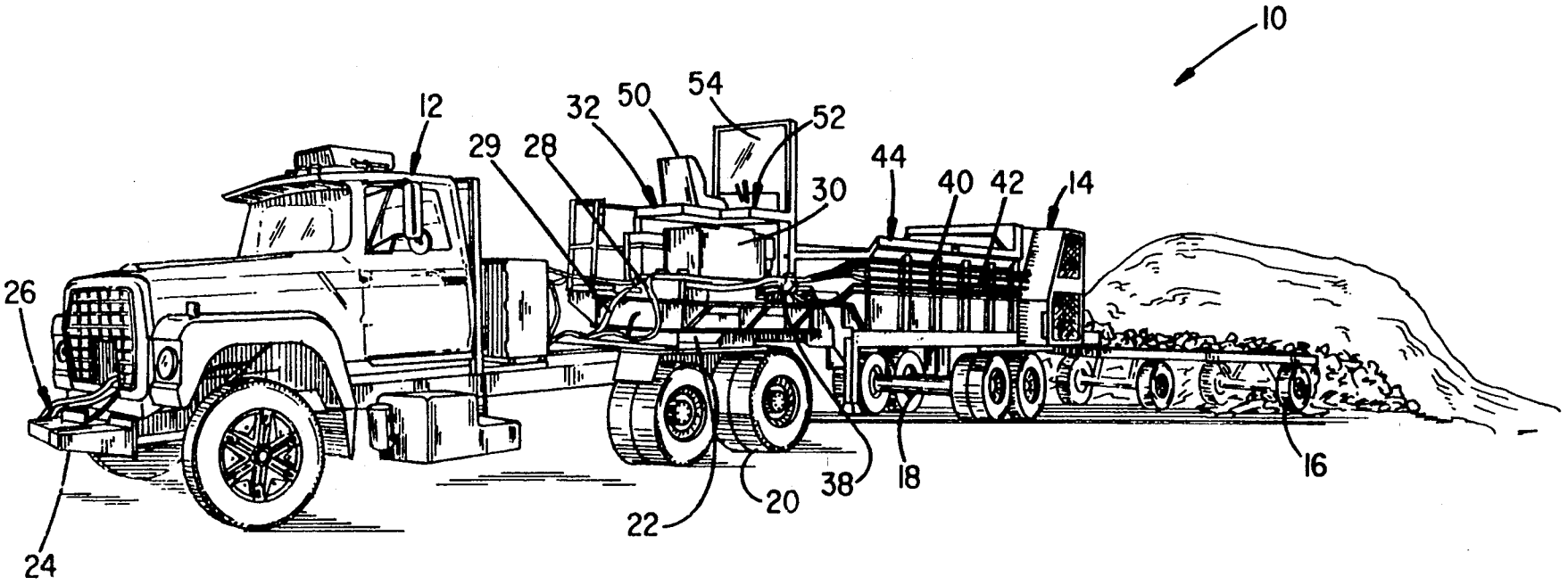
FIG. 1 is a generalized perspective drawing of the shredder of the invention in mounted relation to a transport tractor and a particulate transfer conveyor.

Referring to FIG. 1, a perspective drawing is shown of the present portable shredder assembly 10. The assembly generally includes a fifth wheel transport tractor 12, a shredder framework 14 and a debris conveyor 16. A number of load bearing axles 18 support one end of the framework 14 and accommodate a working load weight of approximately 24,000 pounds.

Secured to a fore-end of the shredder 14 at a so called "fifth wheel" or dollie coupler 22 is the transport tractor 12. Secured to a front bumper 24 of the tractor 12 is a hydraulic pump assembly 26 which derives power from a power-take-off unit 25 (reference FIG. 8) that is coupled to the tractor's engine. Pressurized supply lines 28 and 29 and return lines 31 are directed from the hydraulic pump 26 to couplers at the trailer 14 and, in particular, at a pressurized hydraulic reservoir 30. The pump 26 is sized to achieve typical operating pressures of 4,200 psi at a flow rate of 150 gal/minute.

The reservoir 30 is mounted to an operator platform 32 at the fore-end of the framework 14 and contains approximately 65 gallons of fluid. The reservoir 30 and is normally pressurized to a working pressure in the range of 65 to 100 psi. A sight glass (not shown) is mounted to the side of the reservoir 30 to indicate the system fluid level. A condenser or cooling radiator 34 (reference FIG. 3) mounts beneath and to one side of an operator seat 36. Associated filters and pressure relief valves (reference FIG. 8) are appended about the reservoir 30 to maintain fluid integrity and an adequate working pressure.

Valved couplers are arrayed about the reservoir 30 and framework 14 to mate with the supply and return conduits 29 and 31 from the tractor 12. A primary control valve 38, particularly couples a number of supply conduits 40 and return conduits 42 to driven subassemblies of the shredder 14 which are described in detail below. The supply conduits are shown in solid line and the return conduits are shown in dashed line.

Figure 2:
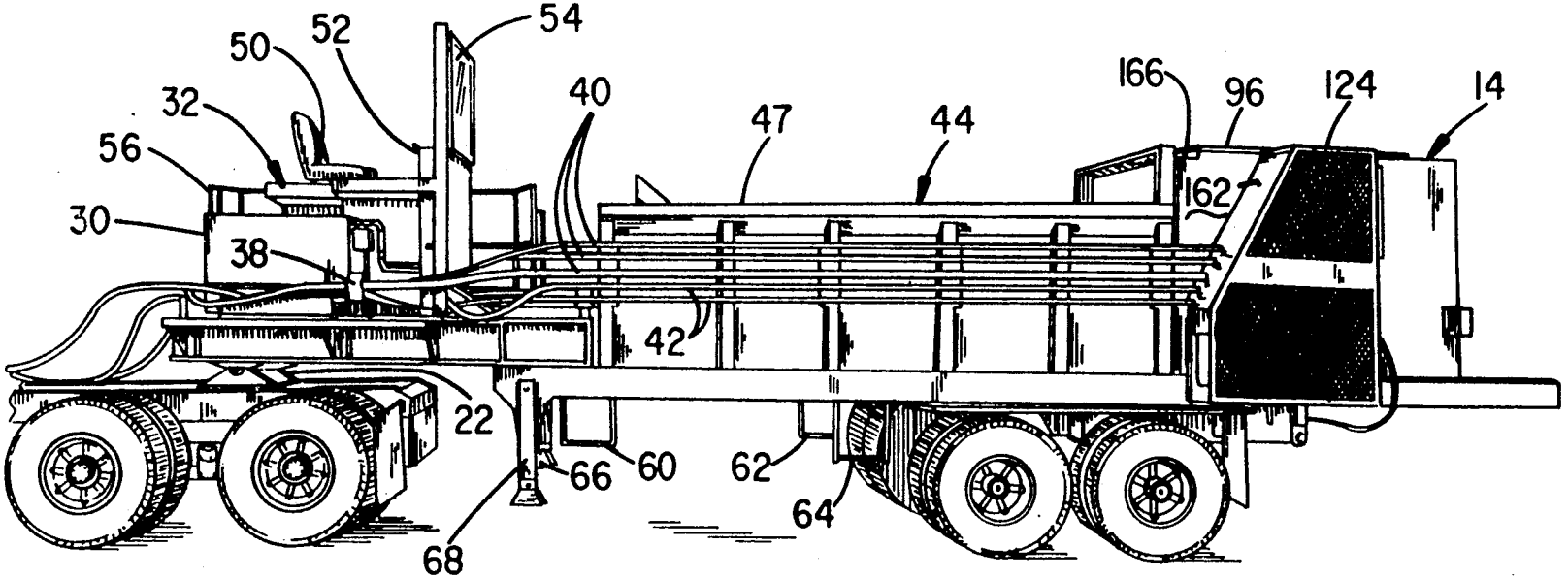
FIG. 2 is a front elevation drawing of the assembly of FIG. 1.

For simplicity of maintenance, the shredder supply conduits 40 and return conduits 42 are primarily arranged along one side of the shredder 14 or to the right of the operator (reference FIG. 2). Such a mounting permits a normal loading of materials into a debris or collection hopper 44 from the operator's left side and without potential damage to the supply/return lines (reference FIG. 3). That is, a front-end loader (not shown) typically deposits the materials to be shredded from the left or from the side opposite of the conduits 40, 42. Outwardly flared, longitudinal rails 46 and 47 extend along either side of the hopper 44 to protect the lines 40, 42 from falling debris.

Mounted forward of an operator seat 50 is a framed console 52 and above which extends a glazed viewing window 54 having a wire mesh backing. The window 54 extends a sufficient height to protect the operator while either seated or standing. Secured to a dashboard of the console 52 are sundry controls for operating the shredder. The details of the controls and the routing of the supply and return conduits 28, 29, 40, 42 are shown in the flow diagram of FIG. 8.

In particular, the console 52 provides (1) an emergency disconnect valve 48, (2) a rotor on/off or "emergency shutoff" valve 49, (3) a gate up/down control valve 51, (4) a ram cycle valve 53, (5) and a pressure monitor gauge 55. The emergency shutoff 49 couples to the primary control or relief valve 38 which is operable to decouple all hydraulic power to the shredder 14.

Figure 3:
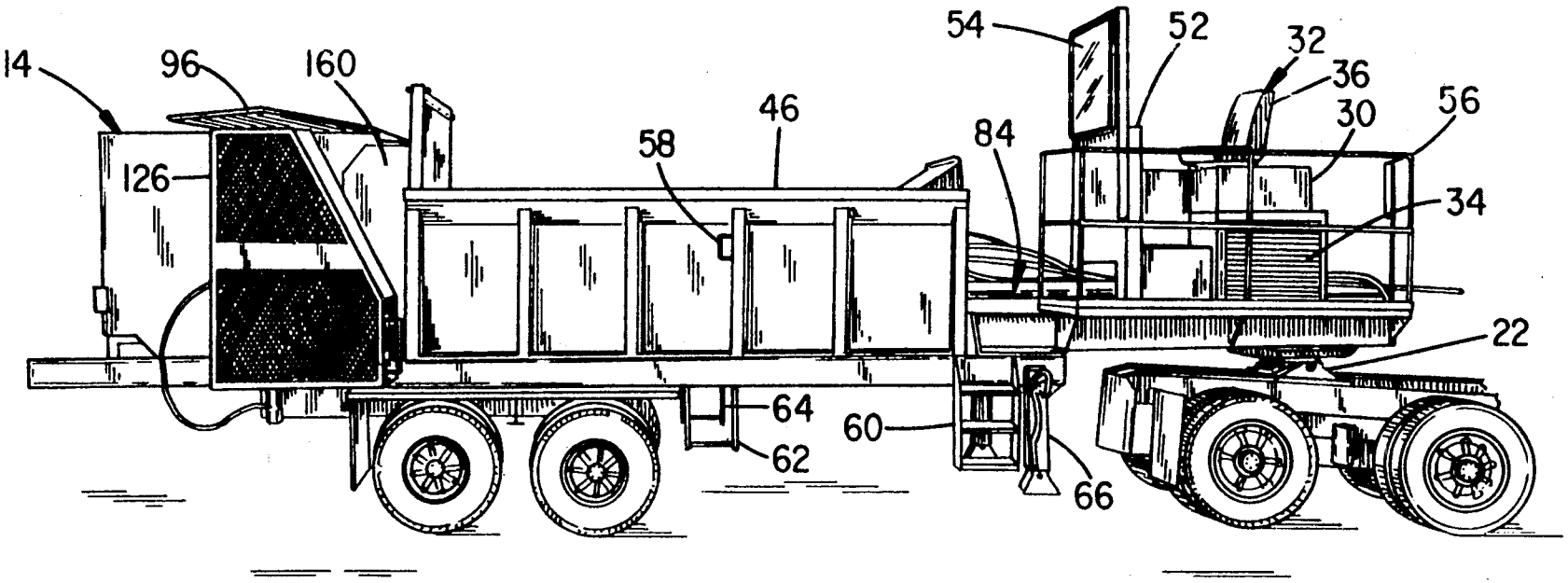
FIG. 3 is a rear elevation drawing of the assembly of FIG. 1.

Also provided about the framework of the shredder 14, which are apparent at FIGS. 2 and 3, are protective guardrails 56, handholds 58 and access steps 60, 62 and 64. A pair of manually winched jack stands 66, 68 also project from the framework to support the shredder 14, should it be preferable to couple a stand-alone hydraulic drive engine to the shredder 14.

Figure 4:
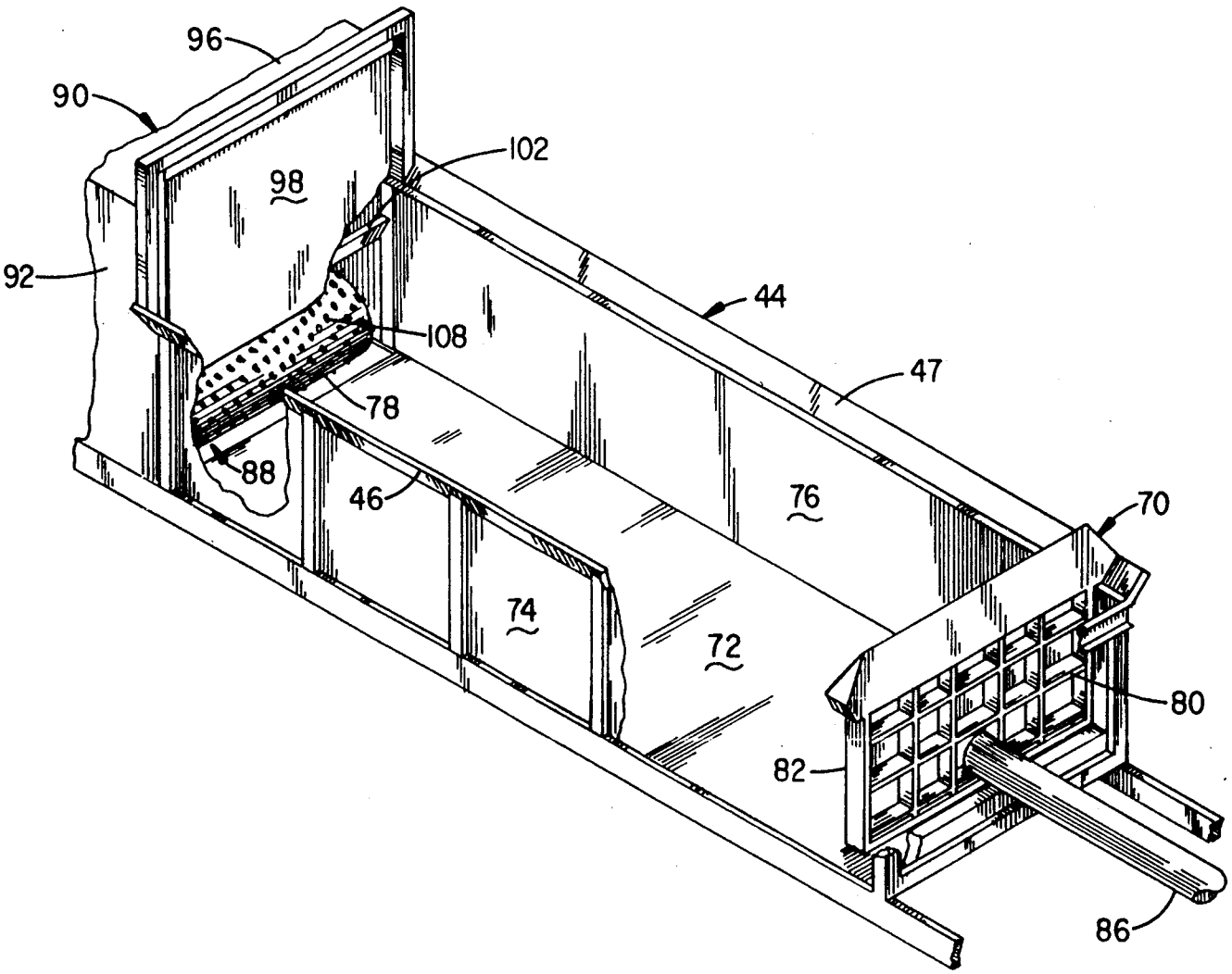
FIG. 4 is a perspective drawing shown in cutaway of the debris hopper and hydraulically controlled endwall in relation to the cutter-head and access opening.

With additional attention to FIG. 4, a perspective drawing is shown in partial cutaway of the debris collection hopper 44. A hydraulically driven endwall 70 extends and retracts along a floor 72 and sidewalls 74, 76 of the hopper 44. Materials deposited into the hopper are thereby directed into contact with a rotating cutter-head 78 mounted at the end of the hopper. The internal dimensions of the hopper accommodate approximately 5 cubic yards of material, although typically lesser amounts on the order of 3.5 yards are shredded with each filling and cycling of the endwall 70.

The moveable endwall 70 is constructed of a braced framework 80 which is covered over with a heavy gauge forward metal wall 82. A hydraulic cylinder 84 having a nominal throw length of 10 feet is coupled at one end to a mounting base (not shown) at the operator platform 32. A forward end of a sliding piston 86 of the cylinder 84 is coupled to the endwall 70. With the filling of the hopper 44, the cylinder 84 is engaged to direct the debris into the exposed portion of the cutter-head 78 and a recessed opening 88 in the floor 72. The cutter-head 78 directs the debris through the opening and a recessed space or reduction channel 89 (reference FIG. 7) and reduces the debris to shredded particulate, which is ejected from the exhaust end 90 of the framework 14.

The cutter-head 78 and an associated hydraulic drive assembly is shrouded by aft sidewall panels 92, 94, an overlying hinged inspection/access cover 96 and suspended, curtains 98 and 100. The curtains 98 and 100 are made of relatively thick conveyor belting and resiliently flex to retain debris within the enclosed confines of the cutter-head. Cross brace members 102, 104 and 106 stabilize the sidewalls 92 and 94 and limit movement of the curtains 98, 100.

Figure 5:
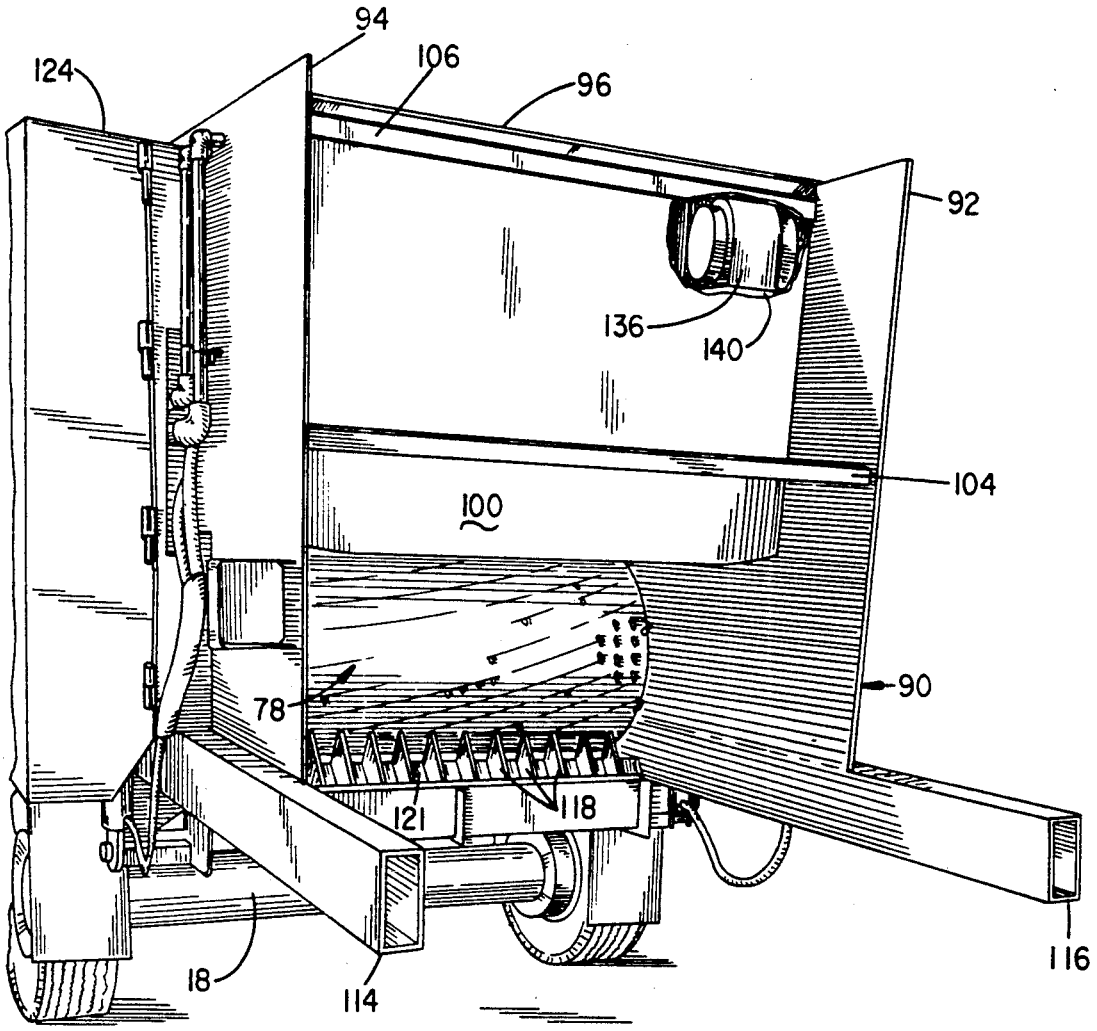
FIG. 5 is a perspective drawing, shown in partial cutaway, of the aft, debris ejection end of the shredder.

With additional attention to FIGS. 5. and 6, the cutter-head 78 includes a plurality of shredder teeth assemblies 108. Each of the teeth assemblies 108 comprise a hooked/pointed tooth 107 which is resiliently retained to the head 78 within a weldment 109 that is secured to the face of the cutting head. The position of the weldment may be varied to direct the teeth 107 for proper shredding. Preferably the teeth must be able to grasp, tear and cut the material while evenly distributing the material over the reduction channel 89. The teeth 107 are individually secured within each weldment 109 with threaded fasteners or snap rings, pins or the like. The teeth assemblies 108 are obtainable from a variety of industrial vendors.

The teeth assemblies 108 are arranged in a plurality of diagonally directed, parallel rows which span the width of the head. Such an arrangement causes the teeth 107 to distribute the materials evenly across the width of the head 78 to minimize potential jam inducing buildup at any one location over the width. Still other arrangements of the teeth can be provided, depending upon the type of materials being shredded. For example, the teeth can be arranged in sinusoidal rows, V-shaped rows, horizontal rows or the teeth can be randomly staggered over the surface of the head 78.

Otherwise, various of the teeth assemblies 110 are mounted along the peripheral edges of the head 78, to position selected ones of the teeth 107 to sweep the space adjacent the sidewalls 92, 94 of any debris which might collect to jam the head 78.

In the event of a jam at the cutter-head 78, a pivotally mounted floor section 112 (reference FIG. 7) which defines the height of the reduction channel 89, can be actuated to increase the gap to the head 78. With a concurrent jogging of the endwall 70, any jammed materials, most often, can be cleared. Alternatively with the retraction of the endwall 70, lowering of the floor section 112 and the shutdown of the cutter-head 78, the jam can be manually cleared. Again, however, most jams are cleared bY merely pivoting the floor section 112 and jogging the endwall 70 to and fro.

The reduction channel 89 extends the width of the hopper 44 and the length of the floor section 112. That is, from the opening 88 formed in the floor 72 to a plurality of rakers 118 mounted aft of the cutter-head 78. The nominal spacing between the floor section 112 and head 78 is approximately 3 inches, although can be increased to 12 inches when clearing a jam or accommodating larger dimensioned debris.

The floor section 112 is formed from a reinforced frame which is covered with a heavy gauge metal. The rakers 118 otherwise project from a piece of channel-stock 121 which is welded to the aft end of the floor section 112.

A vertical edge of each raker 118 adjacent the head is shaped to approximate the curvature of the cutter head 78. The rakers 118 separate the particulate as it is exhausted, as well as determine the particulate size depending upon the spacing between the rakers and the separation of the floor section 112 from the head 78. Depending upon the positioning of a pair of forward pivot weldments 119, greater or lesser opening sizes can be obtained.

As the debris or material is moved past the cutter-head 78, it is reduced to size and exhausted from the exhaust end 90 of the shredder 14, shown at FIG. 5. The shroud curtain 100 directs substantially all of the particulate downward, toward the ground, where it can collect in piles. Alternatively, the ends of the rails 114, 116 of the shredder frame are formed to mate with the powered conveyor 16 shown at FIG. 1 to collect and direct the debris away from the shredder 14. The conveyor 16 may be separately powered or may derive its power from the shredder 14.

Figure 6:
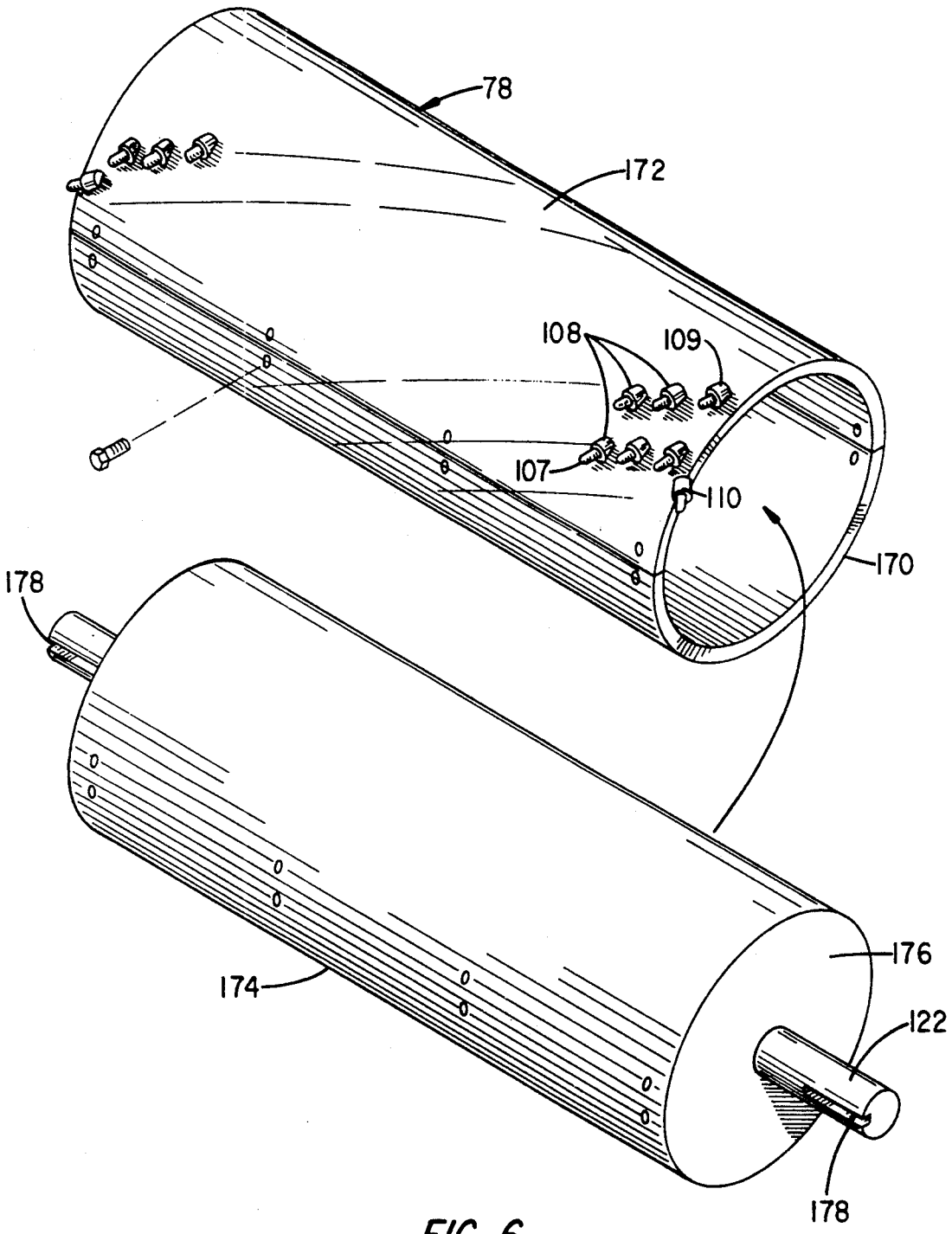
FIG. 6 is a perspective drawing, shown in exploded assembly of the cutter-head.
Figure 7:
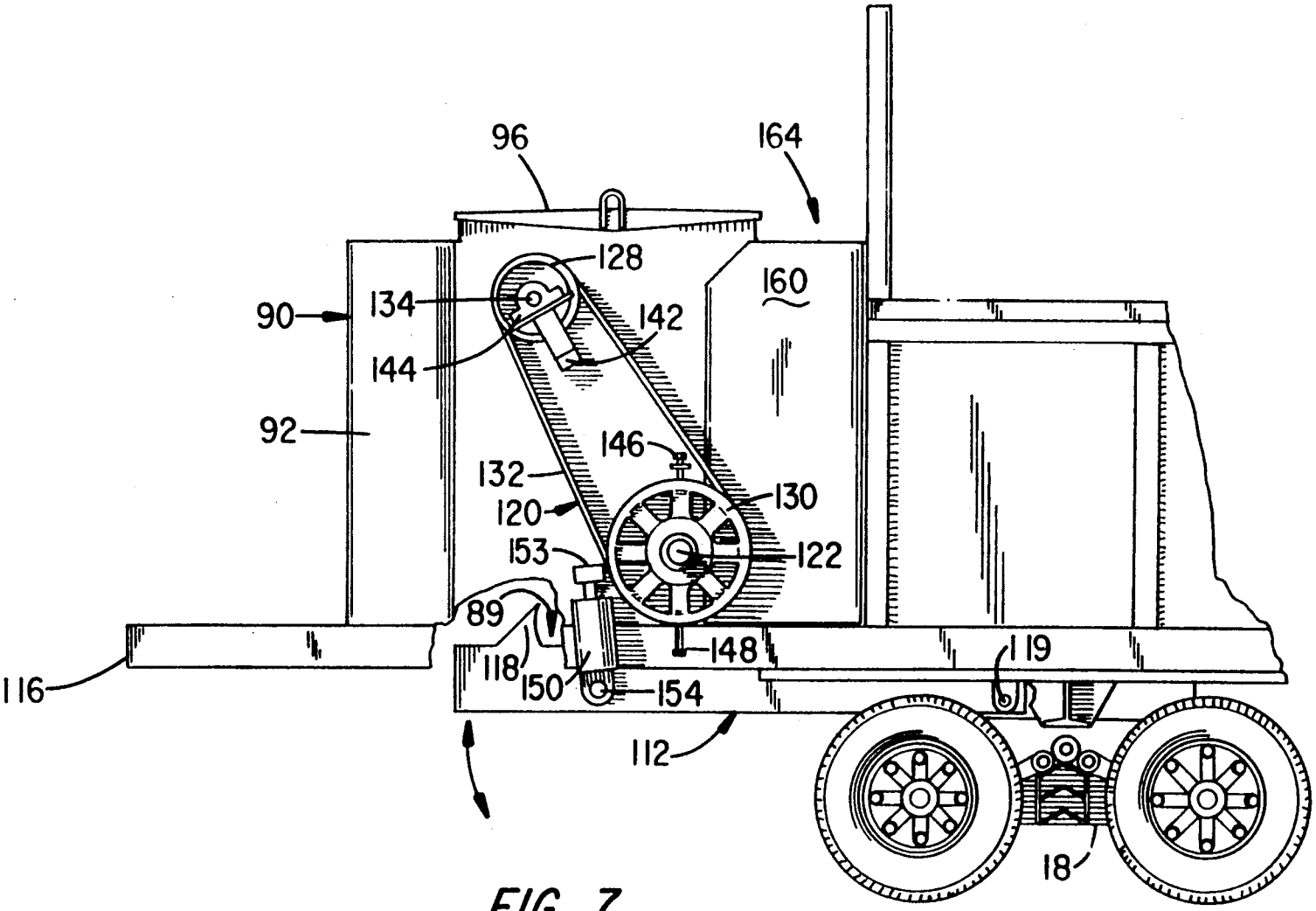
FIG. 7 is an elevation drawing of one of the hydraulic drive assemblies of the cutter-head and wherein a cutaway view is shown of a pivoting sizing floor section.

Referring to FIG. 7 and also to FIG. 6, an elevation drawing is shown in cutaway of one of two identical hydraulic, belted drive assemblies 120 which are mounted to either end of a head drive shaft 122 which supports the cutter-head 78. Each of the drive assemblies 120 is mounted beneath a caged safety cover 124, 126. The covers 124, 126 are hinged to the sidewall panels 94 and 92 and are shown in FIGS. 2 and 3.

Each drive assembly 120 is comprised of a pair of multi-channeled drive and idler pulleys 128 and 130 and about which a number of drive belts 132 are trained. The smaller, upper drive pulley 128 is supported from a shaft 134 which projects from one of a pair of hydraulic motors 136 and 138 (reference FIGS. 5 and 8). The motors 136 and 138 are mounted within an enclosed space above the cutter-head 78 and beneath the safety cover 96. Although only one motor 136 is shown at FIG. 5, two identical motors 136, 138 are provided, which are more apparent at FIG. 8. Each motor 136, 138 is mounted to a rigid cross member 140 that extends between the sidewall panels 92, 94. An L-shaped support arm 142, otherwise, projects from an external surface of the sidewall panel 92 to receive a support bearing 144 whereat an outer-end of the shaft 134 is supported.

Mounted beneath and slightly forward of the drive pulley 128 is the multi-channeled idler pulley 130. The pulley 130 is keyed to one side of the drive shaft 122 that extends from either side of the cutter-head 78. A split, roller bearing support mounted behind the pulley 130 retains the shaft 122 at the sidewall 92. The bearing is mounted between a pair of threaded adjusters 146, 148 which permit a controlled tensioning of the drive belts 132. The head 78 may also be readily detached from the bearing support for repair, replacement etc.. More of the details of head removal are described below.

Figure 8:
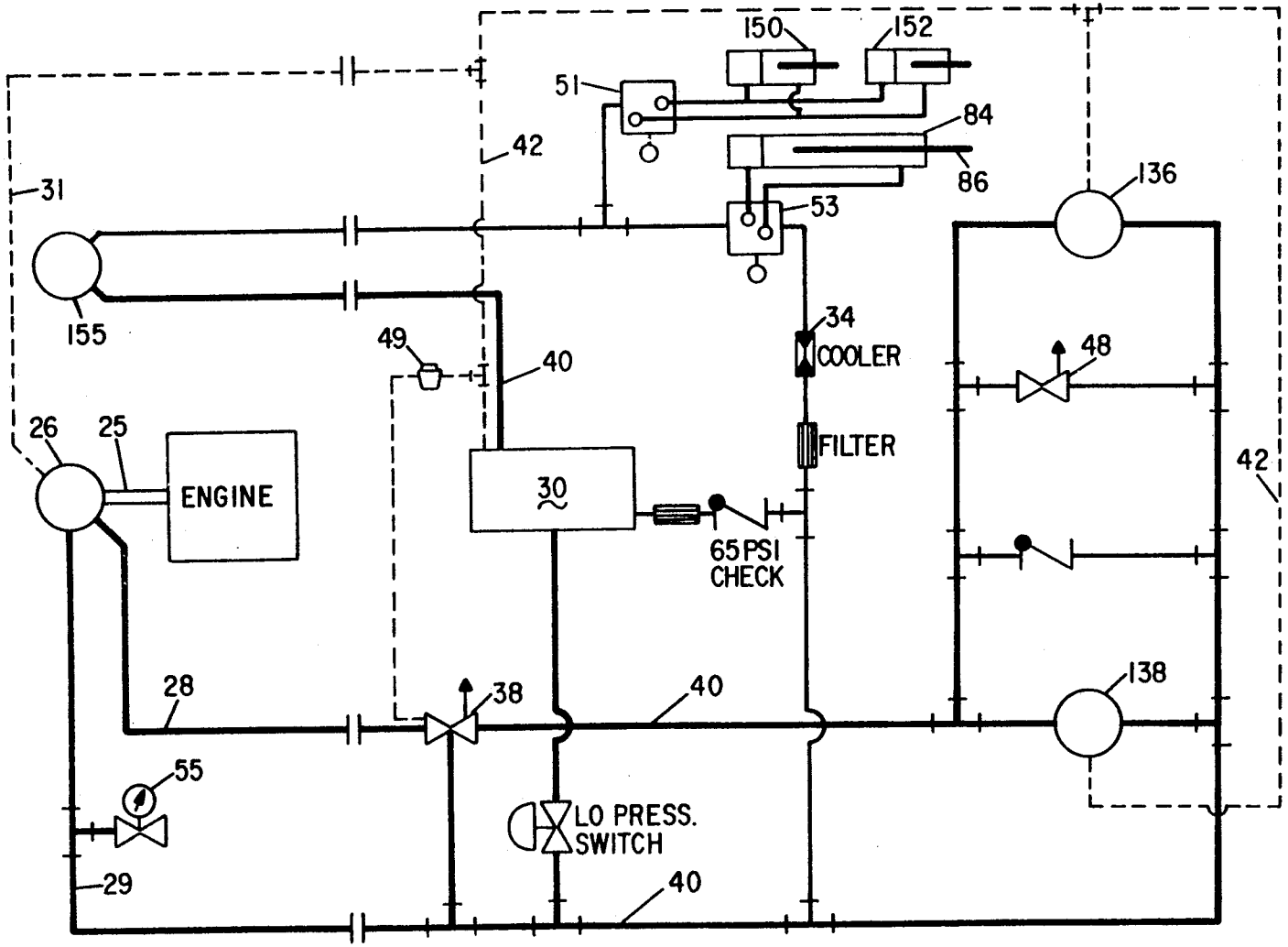
FIG. 8 is a hydraulic flow diagram wherein hi pressure flow is shown in solid line and lo pressure flow in dashed line.

Also protected by the covers 124, 126 are a pair of hydraulic cylinder 150 and 152 (reference FIG. 8). Each cylinder mounts to a weldment 153 which projects from the associated sidewall panel 92 or 94 and an opposite end mounts to a weldment 154 which projects from the floor section 112. Appropriate hydraulic supply and return lines are secured both to the hydraulic cylinders 150 and 152 via an intermediate pump 155. Upon expanding or retracting the cylinders 150, 152, the height of the reduction channel 89 is increased or decreased.

Whereas other shredders of which Applicant is aware rely on single self-contained gas driven engines or electrical motors. These assemblies require extensive power transfer assemblies which extend the length of the shredder, with consequent power losses. Applicant, however, has found that the pair of hydraulic motors 136, 138, mounted adjacent to cutter-head 78, provide more than adequate torque to shred most typically encountered materials, with significantly reduced complexity and cost. Common materials which can be readily shredded are asphalt, concrete, wood, paper, furniture, small gauge metals and other materials such as are commonly found at demolition sites or landfill sites, where the invention finds particular utility. Green wood can also be shredded for the pulp industry.

With continuing attention to FIGS. 6 and 7, the mounting of the cutter-head 78 to the shredder is also more apparent. In particular, a pair of plates 160, 162 are respectively fastened to the sidewall panels 92, 94 to cover slotted access channels 164, 166 formed in the sidewalls. During assembly or disassembly, the ends of the head drive shaft 122, are directed along the slotted channelways 164, 166 to mount to the drive assemblies 120. Ready access is thus provided to the cutter-head 78, once the drive shaft 122 is released from the bearing supports, tensioners 146, 148 and idler pulleys 130, and without disrupting the mountings of the hydraulic motors 136, 138.

The cutter-head 78 can particularly be accessed within a matter of minutes, should it be desired to replace the head with another head having a distinguishable arrangement of teeth assemblies for other types of materials. In contrast, other known shredders require extensive disassembly of the cutter-head from the full length drive systems provided therewith.

Lastly, the cutter-head 78 is constructed in sectional or modular form of two arcuate plates 170, 172 which mount to a center drum 174. The plates 170 and 172 support the teeth assemblies 108. Each plate is cut from one inch thick tubular piping to an approximate length of 5 feet. The plates, in turn, are separately bolted to the center drum 174. The head drive shaft 122, extends through the opposite end walls 176 and contains slotted, end keyways 178 for aligning and retaining the shaft 122 to the idler pulleys 130.

While the invention has been described with respect to its presently preferred construction and various considered modifications and improvements thereto, it is to be appreciated still other constructions may suggest themselves to those skilled in the art. Accordingly the following claims should be interpreted to include all those equivalent embodiments within the spirit and scope thereof.

What is claimed is:

1. Shredder apparatus comprising:

a) a transport vehicle including hydraulic pump means coupled to a drive engine and a plurality of conduits for pressurizing a fluid within the conduits; and b) trailer means detachably coupling to said transport vehicle and including (1) an operator platform having a collection hopper for receiving work materials and wherein said hopper includes at least one movable wall, (2) cutter-head means coupled to said conduits and having a hydraulically driven cutter-head containing a plurality of teeth for shredding the work materials, (3) means for extending and retracting said movable wall to direct the work materials into contact with the cutter head, (4) a reduction channel defined between said cutter head and an adjacent portion of a floor of said hopper and wherein the work materials are shredded; and (5) means for controlling the separation between the cutter head and the adjacent floor portion and thereby the size of shredded particulate.

2. Apparatus as set forth in claim 1 wherein said means for extending and retracting the movable wall comprises a hydraulic ram.

3. Apparatus as set forth in claim 2 wherein said cutter-head means includes first and second hydraulic motors and wherein each of said motors is coupled to said conduits and respective opposite end of a drive shaft of said cutter-head.

4. Apparatus as set forth in claim 3 wherein each of said first and second motors are coupled to said drive shaft via a first pulley secured to one of said motors, a second pulley secured to an end of said drive shaft, and a plurality of belts coupled between the first and second pulleys and further including means for tensioning said plurality of belts.

5. Apparatus as set forth in claim 4 wherein said cutter-head comprises a cylindrical housing having first and second end walls and through which end walls the drive shaft extends, first and second arcuate plates, wherein a plurality of said teeth project from an exposed surface of each of said first and second plates and an inner surface of each of said first and second plates mates with said housing, and means for securing said first and second plates to said housing.

6. Apparatus as set forth in claim 5 wherein said plurality of teeth are arranged in a plurality of parallel rows which rows diagonally extend across the exposed surface of the first and second arcuate plates.

7. Apparatus as set forth in claim 6 wherein ones of said teeth project into a space between an end of the cutter-head and a sidewall of said hopper to clear materials therefrom and thereby prevent jamming of the cutter-head means.

8. Apparatus as set forth in claim 4 wherein each of first and second sidewalls of said hopper include first and second vertical channelways defined adjacent the cutter-head means and, whereby said cutter-head is admitted or removed from said hopper.

9. Apparatus as set forth in claim 1 wherein said floor portion is mounted to pivot and includes a plurality of laterally displaced rakers, wherein each raker projects from the floor portion a predetermined height and is spaced apart from each adjacent raker a predetermined distance.

10. Apparatus as set forth in claim 1 wherein said operator platform includes a seat and an upright viewing window.

11. Apparatus as set forth in claim 1 wherein said cutter-head means comprises first and second hydraulic motors, wherein each motor is coupled to a drive pulley, wherein first and second idler pulleys are coupled to respective opposite ends of a drive shaft of said cutter-head, and including a plurality of endless belts trained about the respective first idler and first drive pulleys and second idler and second drive pulleys and further including means for tensioning said belts.

12. Apparatus as set forth in claim 1 including means coupled to an exhaust end of the trailer means for receiving shredded particulate and conveying said particulate to a collection point displaced from said trailer means.

13. Shredder apparatus comprising:

a) a transport vehicle including hydraulic pump means coupled to a drive engine and a plurality of conduits for pressuring a fluid within the conduits;

b) trailer means detachably coupling to said transport vehicle and including (1) an operator platform, (2) an open-topped collection hopper for receiving work materials, (3) means for extending and retracting a wall of said hopper, (4) means for pivoting a portion of a floor of said hopper, which floor portion contains a plurality of 11 laterally displaced rakers which project therefrom, and (5) cutter-head means coupled to said conduits and having a cylindrical cutter-head containing a plurality of teeth which project therefrom for shredding materials admitted to the collection hopper and wherein respective ends of a drive-shaft of the cutter-head are coupled to first and second hydraulic motors via first and second multi-channeled drive pulleys, first and second multi-channeled idler pulleys, means for varying the mounting position of the first and second idler pulleys and a plurality of belts which are trained about the first and second idler and first and second drive pulleys, and whereby the materials are directed into contact with the cutter-head and reduced to a particulate in a channel space defined between the portion of the hopper floor and the cutter-head; and (c) means coupled to an exhaust end of the trailer means for receiving shredded particulate and conveying said particulate to a collection point displaced from said trailer means.

14. Shredder apparatus comprising:

a) a transport vehicle including hydraulic pump means coupled to a drive engine and a plurality of conduits for pressurizing a fluid within the conduits; and b) trailer means detachably coupling to said transport vehicle and including (1) an operator platform having a collection hopper for receiving work materials and wherein said hopper includes at least one movable wall, (2) cutter-head means coupled to said conduits and having a hydraulically driven cutter-head containing a plurality of teeth for shredding the work materials, (3) means for extending and retracting said movable wall to direct the work materials into contact with the cutter head, (4) a reduction channel defined between said cutter head and an adjacent portion of a floor of said hopper, wherein the floor contains a plurality of rakers which project from the floor and wherein the work materials are shredded; and (5) controlling the separation between the cutter head and the adjacent floor portion and thereby the size of shredded particulate.

* * * * *